United States Patent [19]

Drayton

[11] 3,939,677

[45] Feb. 24, 1976

[54] THEFT DETERRENT CHAIN LOCKING DEVICE

[75] Inventor: Walker E. Drayton, York, Pa.

[73] Assignee: American Chain & Cable Company, Inc., Bridgeport, Conn.

[22] Filed: Apr. 23, 1973

[21] Appl. No.: 353,461

[52] U.S. Cl. ..... 70/14; 70/18

[51] Int. Cl.[2] ..... E05B 73/00

[58] Field of Search ..... 70/14, 15, 18, 93; 24/116 R; 59/93

[56] References Cited

UNITED STATES PATENTS

| | | | |
|---|---|---|---|
| 1,523,287 | 1/1925 | Rawlins | 24/116 R |
| 1,921,434 | 8/1933 | Stone | 70/18 X |
| 2,179,564 | 11/1939 | Smith | 59/93 X |

FOREIGN PATENTS OR APPLICATIONS

| | | | |
|---|---|---|---|
| 671,413 | 5/1952 | United Kingdom | 24/116 R |

*Primary Examiner*—Robert L. Wolfe

*Attorney, Agent, or Firm*—Pennie & Edmonds

[57] ABSTRACT

An adjustment control device for a chain. The control device includes a body member having a first orifice for slidably receiving the chain and a second orifice extending crosswise of the first orifice for receiving a shackle of a lock. After a chain has been inserted into the body member, the shackle of the lock is inserted into the second orifice between two alternate links of the chain without passing through the link connecting those alternate links to lock the chain in position.

3 Claims, 4 Drawing Figures

THEFT DETERRENT CHAIN LOCKING DEVICE

BACKGROUND OF THE INVENTION

When locking bicycles and other portable objects to fixed objects in an attempt to prevent theft, several locking devices have been used, the most common of which is a length of chain and a commercial padlock. Both the chain and the padlock are made of hardened metal to resist cutting or other means of destruction. The padlock shackle is normally similar to that of the chain so that they both will resist an equal amount of destruction. As a result of their similarity in characteristics, the size of the shackle of the lock is such that it cannot pass through a normal link of the chain. To overcome this problem and still use the proper padlock, the chain is provided with one or more larger links, large enough to allow the passage of the padlock shackle.

In use, the chain is normally passed around or through the bicycle or article to be secured and around a hitching post or other fixed object. The padlock shackle is then passed through the larger links and locked. With this manner of attachment, there will often be a large degree of slack allowing relative movement between the article and the object to which it is secured. Where this slack exists, the chain may be more vulnerable to unauthorized removal than if it were maintained in a taut condition.

Slack chains can also permit damage to the secured article and this is particularly problemsome where a chain is used as a safety chain with a towed vehicle. When using a trailer hitch or other towing means for towing a trailer, a safety chain is used to prevent disconnection if the hitch fails. The safety chain must normally be maintained in a slack or loose disposition due to its construction. Because of this, the towed vehicle may swing wildly behind the towing vehicle if the main hitch fails; and this will present a dangerous situation to other traffic on the highway.

SUMMARY OF THE INVENTION

With the present invention, an adjustable chain locking device is provided for locking bicycles and other portable objects in a taut condition to secure them from theft and damage. The device includes a body member having two openings or orifices, one for receiving a conventional chain and the other for receiving the shackle of a padlock. The opening for the chain is a cross-shaped orifice which allows the chain to move through the body member; but prevents rotation of the links about the axis of the chain. Thus, alternate links of the chain are maintained in a coplanar orientation within the body member with the intermediate connecting links in a plane generally perpendicular thereto.

The orifice in the body member for receiving the shackle of the padlock intersects one leg of the cross-shaped orifice. When the chain is pulled through to the desired position, the shackle is inserted through its orifice and between two alternate links. The shackle takes up enough of the space between the alternate links and the connecting link to prevent axial movement of the chain through the body member.

When the locking device of the present invention is to be used with a safety chain for towing a vehicle, the shackle member is provided with an extended arm on which the body member of the locking device is slidably mounted. The body member is biased toward the shackle such that in the normal position, the shackle remains in an orifice provided for it in the body member. To operate and lock, the body member is slid on the extended arm away from the shackle and against the biasing force allowing the chain to be inserted in the orifice and pulled through the body member to the desired position. Upon releasing the body member, the biasing force will move the body member back into the intersection with the shackle; thus locking the chain into position.

DETAILED DESCRIPTION OF THE PREFERRED EMBODIMENT

Figure 1:
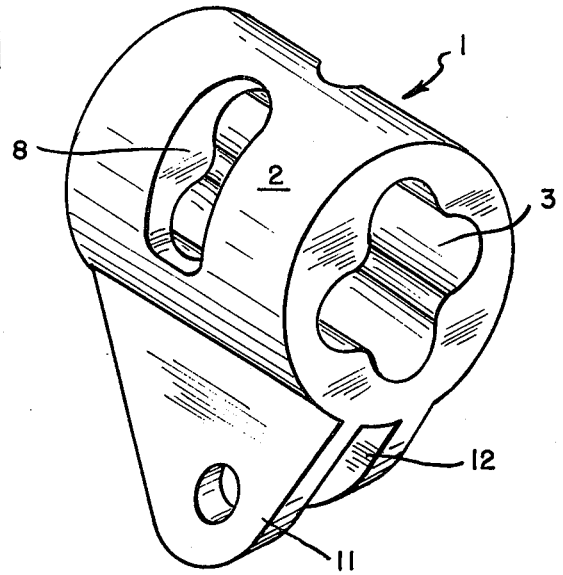
FIG. 1 is a perspective view of the body member portion of the locking device.
Figure 2:
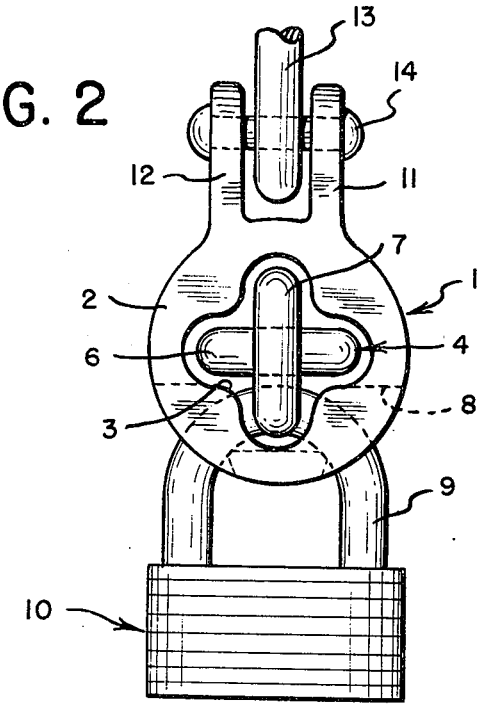
FIG. 2 is a front view of the body member showing a chain locked into place by a padlock.

As shown in FIG. 1, the locking device includes an adjustment control device generally designated by reference numeral 1 and comprising a body member 2. This member is generally cylindrical in shape and provided with a cross-shaped orifice 3 extending along its longitudinal axis for slidably receiving a chain 4. As can be seen in FIG. 2, the dimensions of the orifice 3 are only slightly larger than those of links of the chain 4. The shape of the orifice 3 provides a means for preventing the chain links from rotating. The configuration of the orifice 3 also maintains alternate links of the chain in a common plane and the intermediate connecting link in a plane essentially perpendicular thereto. In the drawings, two alternate links are designated by reference numerals 5 and 7 while the intermediate connecting link which is associated with these two alternate links is designed by reference numeral 6.

A second orifice 8 is provided in the body member and extends crosswise to the first orifice 3. The second orifice 8 is located a sufficient distance from the center line of the first orifice to allow passage of shackle 9 of a standard padlock 10 without interfering with the connecting link 6. The second orifice is small enough, however, to maintain the shackle in the path of axial movement of the alternate links 5, 7 and thus prevent axial movement of the chain through the body member.

Figure 3:
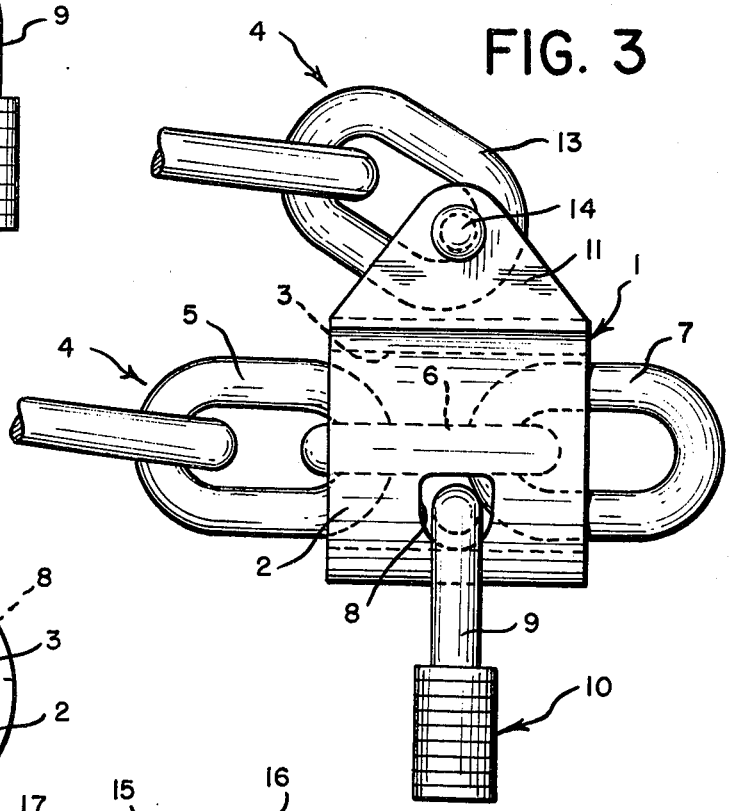
FIG. 3 is a side view of the locking device as shown in FIG. 2.

The body member 2 has two flanges 11 and 12 extending therefrom for attachment to a suitable carrier for the locking device. In FIGS. 2 and 3 the carrier is shown as a link 13 of a chain 4. The connection to the link 13 is made by a rivet 14 passing through the link 13 and attached to the flanges 11 and 12.

In operation, the free end of the chain 4 is first passed through or around the object to be secured, for instance a bicycle. It is then passed around an element such as a tree or post to which it is desired to secure the bicycle. After passing the chain in this manner, the free end is inserted into the first orifice 3 of the body member and pulled through to the desired point along the length of the chain. The shackle 9 of padlock 10 is then inserted into the second orifice 8 between two coplanar links 5 and 7 and locked back into the padlock 10. This locks the chain in place about the object and the structure to which the object is being secured. By having this adjustability feature when locking objects to fixed structures, theft becomes more difficult and the possibility of damage due to the object falling is lessened.

Figure 4:
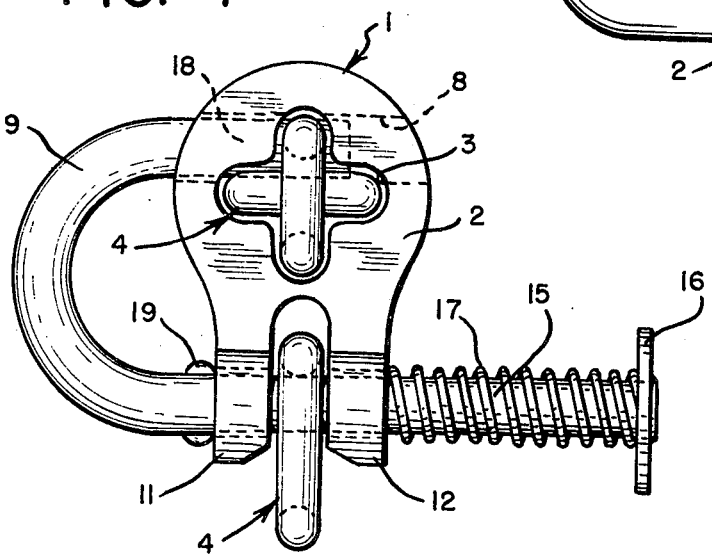
FIG. 4 is a front view of a modified embodiment of the present invention wherein the body member is slidably mounted on the shackle of the locking device.

Another embodiment of applicant's device uses a spring loaded lock pin as shown in FIG. 4. Here the lock pin includes a shackle 9 with an extended arm portion 15. A stop washer 16 is attached to the end of the arm. The flanges 11, 12 of the body member 2 of the locking device have openings large enough to allow the arm of the shackle to pass through them. In this way the body member is slidably mounted on the extended arm 15 of the shackle.

A helical compression spring 17 circumscribes the extended arm of the shackle between the lock washer 16 and flange 12 of the body member. The spring is biased to force the body member toward the shackle portion of the lock pin. The body member is orientated such that the second orifice 8 is opposite the end 18 of the shackle 9. In the normal position, the body member is forced into a position where the end 18 of the shackle 9 extends through the second orifice 8 and between coplanar links 5 and 7 as described above with reference to the embodiment of the invention shown in FIGS. 1–3. Stop means in the form of a bead 19 is positioned on the extended arm 15 facing the flange 11 to limit the movement of the body member toward the shackle end. The positioning of this bead is at a point on the extended arm to prevent the body jamming onto the shackle end. The chain for use with this device is attached to the extended arm between the flanges 11, 12.

The locking device may be attached between a towing vehicle and a towed vehicle by inserting the chain around or through suitable parts of the framework of both vehicles. Alternatively, one end of the chain may be welded to the framework of the towed vehicle and the body member connected to the chain intermediate its length. The body member 2 is then moved on the extended arm 15 against the bias of the spring 17 to disengage it from the shackle 9. The free end of the chain is then inserted and pulled through the orifice 3 to the desired position. Upon removing the force used to move the body member on the extended arm to thereby open the locking device, the body member will move to its normal position with the shackle positioned in the orifice 8 and the chain locked in position with the desired degree of tautness. By using the adjustable locking device as part of a safety chain when towing a vehicle, more control over the towed vehicle is provided should the primary hitch ever break.

I claim:

1. An adjustable locking device comprising:

a. a chain;

b. a locking shackle having an extended arm portion;

c. an adjustment device including:

1. a first orifice extending therethrough for slidably receiving the chain and holding it against rotation,

2. a second orifice extending crosswise of the first orifice for receiving the shackle member in the path of axial movement of alternate links of the chain, and

3. spaced apertured flanges for receiving the end link of said chain therebetween and the extended arm of the shackle member therethrough; and d. spring means mounted about the extended arm and urging the body member in one direction to normally position the shackle in the second orifice of said body member.

2. The device according to claim 1 further comprising:

a. stop means positioned on the extended arm of the shackle for limiting the movement of said body member toward the shackle and to prevent jamming thereof.

3. An adjustable locking device comprising:

a. a chain;

b. locking shackle member having an extended arm portion;

c. an adjustment device including a body member having

1. a first orifice extending therethrough for slidably receiving the chain and holding it against rotation, and

2. a second orifice extending crosswise of the first orifice for receiving the locking shackle member in the path of axial movement of alternate links of the chain; and, d. attaching means for attaching the body member to one link of said chain, said attaching means including

1. spaced apertured flanges extending from said body for receiving the end link of said chain, and said extending arm portion of said locking shackle member extending through said apertured flanges of said body member and through the end link of the chain.

* * * * *